US010012182B2

(12) United States Patent
Ishikawa et al.

(10) Patent No.: US 10,012,182 B2
(45) Date of Patent: Jul. 3, 2018

(54) FUEL VAPOR PROCESSING APPARATUS

(71) Applicant: AISAN KOGYO KABUSHIKI KAISHA, Obu-shi, Aichi-ken (JP)

(72) Inventors: Tetsuya Ishikawa, Obu (JP); Norihisa Yamamoto, Aichi-ken (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 32 days.

(21) Appl. No.: 15/062,999

(22) Filed: Mar. 7, 2016

(65) Prior Publication Data

US 2016/0265481 A1 Sep. 15, 2016

(30) Foreign Application Priority Data

Mar. 10, 2015 (JP) ..... 2015-046944

(51) Int. Cl.
*F02M 33/02* (2006.01)
*F02M 25/08* (2006.01)

(52) U.S. Cl.
CPC .... *F02M 25/0854* (2013.01); *F02M 25/0836* (2013.01); *F02M 25/0872* (2013.01)

(58) Field of Classification Search
CPC ..... F02M 25/0854; F02M 25/0836; F02M 25/0872
USPC ..... 123/520
See application file for complete search history.

(56) References Cited

U.S. PATENT DOCUMENTS 4,938,248 A * 7/1990 Browne ..... A01G 25/167 137/78.3
5,518,018 A * 5/1996 Roetker ..... B60K 15/03519 137/43
6,003,539 A * 12/1999 Yoshihara ..... B60K 15/03519 137/202
7,234,452 B2 * 6/2007 Mills ..... B60K 15/03504 123/516
8,888,901 B2 * 11/2014 Kimoto ..... B01D 53/0446 123/519
9,828,952 B2 * 11/2017 Takahashi ..... F02M 25/0854
2010/0319789 A1 * 12/2010 Erdmann ..... F02M 25/0836 137/202

(Continued)

FOREIGN PATENT DOCUMENTS

JP H08-100711 A 4/1996
JP H11-208293 A 8/1999
WO 2013018215 A1 2/2013

OTHER PUBLICATIONS

Japanese Office Action dated Mar. 23, 2018, for Japanese Application No. 2015-046944 (3 p.).

(Continued)

*Primary Examiner* — Hung Q Nguyen
*Assistant Examiner* — Anthony Taylor, Jr.
(74) *Attorney, Agent, or Firm* — Conley Rose, P.C.

(57) ABSTRACT

A fuel vapor processing apparatus may include a diaphragm valve disposed in a vapor path communicating between a fuel tank and a canister. The diaphragm valve may include a valve chamber, a backpressure chamber, a diaphragm partitioning the valve chamber and the backpressure chamber from each other; and a valve member attached to the diaphragm. The backpressure chamber is not directly opened to an outside of the diaphragm valve. A control valve device may control a pressure within the backpressure chamber of the diaphragm valve.

11 Claims, 7 Drawing Sheets

(56) References Cited

U.S. PATENT DOCUMENTS

2014/0137964 A1* 5/2014 Aso ..... F02M 25/0836
137/587

OTHER PUBLICATIONS

English Translation of Japanese Office Action dated Mar. 23, 2018, for Japanese Application No. 2015-046944 (3 p.).

* cited by examiner

FUEL VAPOR PROCESSING APPARATUS

CROSS-REFERENCE TO RELATED APPLICATIONS

This application is based upon and claims priority to Japanese Patent Application Serial No. 2015-046944 filed on Mar. 10, 2015, the contents of which are incorporated in their entirety herein by reference in their entirety for all purposes.

STATEMENT REGARDING FEDERALLY SPONSORED RESEARCH OR DEVELOPMENT

Not applicable.

BACKGROUND

The disclosure generally relates to an apparatus for processing fuel vapor that may be generated in a fuel tank.

In a practically used fuel processing apparatus, a canister may be connected to a fuel tank via a vapor path and may adsorb fuel vapor generated in the fuel tank. The canister may be further connected to an engine, such as an internal combustion engine of an automobile, via a purge path, so that an intake negative pressure generated by the operation of the engine may desorb the fuel vapor from the canister. Due to a demand for an improvement in terms of a processing ability of the fuel vapor processing apparatus, various studies have been made for an increase in the adsorption capacity of the canister and for an increase in the purge flow rate. However, the increase in the adsorption capacity of the canister and the increase in the purge flow rate may lead to an increase in the pressure loss of the canister at the time of purging. Therefore, the negative pressure applied to the fuel tank via the vapor path at the time of purging may increase to cause unfavorable deformation of the fuel tank. Further, if the fuel vapor generated in the fuel tank is directly drawn into the engine, the air fuel ratio of the engine may be disturbed. In view of this, it has been proposed to provide a cutoff valve in the vapor path. The cutoff valve may be closed at the time of purging so that no negative pressure equivalent to the purge negative pressure may be applied to the fuel tank. Japanese Laid-Open Patent Publication No. 8-100711 discloses an apparatus equipped with a valve serving as the cutoff valve.

However, the cutoff valve disclosed in Japanese Laid-Open Patent Application No. 8-100711 is a diaphragm valve having a diaphragm. The atmospheric pressure is necessary to be applied to a backpressure chamber partitioned by the diaphragm for the operation of the valve. For this purpose, a structure is employed to open the backpressure chamber to the atmosphere. As is well known, the fuel vapor processing apparatus is necessary to be designed so as not to cause leakage of fuel vapor into the atmosphere. In a structure of the cutoff valve of Japanese Laid-Open Patent Application No. 8-100711, a space into which the fuel vapor flows and a space opened to the atmosphere are positioned adjacent with each other with an intervention of the diaphragm. Therefore, there is a possibility that fuel vapor leaks into the atmosphere when the diaphragm has been accidentally damaged.

In view of the challenges discussed above, there is a need in the art for a technique of preventing potential leakage of fuel vapor into the atmosphere from a diaphragm valve.

SUMMARY

In one aspect according to the present disclosure, a fuel vapor processing apparatus may include a diaphragm valve disposed in a vapor path communicating between a fuel tank and a canister. The diaphragm valve may include a valve chamber, a backpressure chamber, a diaphragm partitioning the valve chamber and the backpressure chamber from each other; and a valve member attached to the diaphragm. The backpressure chamber is not directly opened to an outside of the diaphragm valve. A control valve device may control a pressure within the backpressure chamber of the diaphragm valve.

In one embodiment, a fuel vapor processing apparatus may include a canister. The canister may be in fluid communication with a fuel tank via a vapor path and may adsorb fuel vapor generated in the fuel tank. The canister may be further in fluid communication with an engine via a purge path and may be further configured to allow the adsorbed fuel vapor to be desorbed and purged to the engine by an intake negative pressure generated by the engine when the engine is operating. The apparatus may further include a diaphragm valve configured to open and close the vapor path. The diaphragm valve may include a valve chamber in fluid communication with the vapor path, a backpressure chamber arranged so as to be opposed to the valve chamber, and a diaphragm partitioning the valve chamber and the backpressure chamber from each other, so that a volume of the valve chamber and a volume of the backpressure chamber may vary according a pressure difference between the valve chamber and the backpressure chamber. A valve member may be arranged on a side of the valve chamber and may be integrated with the diaphragm. A tubular passage member may define a part of the vapor path and may be in fluid communication with the canister. The tubular passage member may have an open end that is disposed within the valve chamber and opposed to the valve member. When a negative pressure is applied to the open end of the tubular passage member via the canister, the valve member may move to contact and close the open end for shutting off the vapor path. The backpressure chamber may be in communication with the canister via a first communication path and may be further in communication with the fuel tank via a second communication path. The apparatus may further include a flow control valve configured to control a flow of a gas, i.e. a mixture of air and fuel vapor, flowing from the fuel tank to the canister via the backpressure chamber and the first and second communication paths. The flow control valve may be closed when a flow rate of the gas per unit time is equal to or more than a predetermined value. The flow control valve may be opened when the flow rate of the gas per unit time is less than the predetermined value.

During a purge operation, the pressure within the backpressure chamber may be equal to an atmospheric pressure, for example, due to communication with an atmospheric port of the canister. Therefore, if a negative pressure is applied to the tubular passage member of the diaphragm valve at a time of starting the purge operation, the valve member may be moved by the negative pressure to contact with the open end of the tubular passage member, so that the vapor path may be shut off. In this way, the negative pressure used for the purge operation may not be applied to the fuel tank. Further, if the flow rate of gas flowing though the flow control valve by the negative pressure increases to be equal to or more than the predetermined value, the flow control valve may be closed. In this way, the negative pressure used for the purge operation may not be applied to the fuel tank via the flow control valve.

On the other hand, if fuel vapor is generated in the fuel tank when the engine is at rest or stopped, the valve member of the diaphragm valve may move away from the open end of the tubular passage member according to an increase of the pressure within the fuel tank, so that the fuel vapor may be adsorbed by the canister via the vapor path. During this operation, even in the case that an increase in the pressure within the fuel tank is not sufficient to cause movement of the valve member from the open end of the tubular passage member, the fuel vapor may still be allowed to flow into the canister via the first and second communication paths, the backpressure chamber and the flow control valve.

Further, for performing an on-board diagnosis (OBD), in particular, an air leakage diagnosis for the fuel vapor processing apparatus inclusive of the fuel tank and the canister, an OBD pump may be connected to the canister and may apply a weak (i.e., relatively small) negative pressure to the canister. The flow control valve may be opened so that the negative pressure can be applied to fuel tank via the first and second communication paths, the backpressure chamber and the flow control valve. Therefore, it may be possible to perform the on-board diagnosis even with the use of the diaphragm valve.

Furthermore, the backpressure chamber of the diaphragm valve is not directly opened to the atmosphere but may be connected to the canister. Therefore, even in the event that the diaphragm has been accidentally damaged, the fuel vapor flown from within the fuel tank to the backpressure chamber may flow into the canister without being discharged to the atmosphere. Furthermore, the diaphragm valve may automatically mechanically operate without need of an electric control, and therefore, the diaphragm valve can be manufactured at a relatively low cost.

The flow control valve may be integrated with the diaphragm valve. In one example, the flow control valve may be disposed at a region of the diaphragm valve where the backpressure chamber and the first communication path are connected to each other. With this arrangement, it is possible to simplify the construction of the fuel vapor processing apparatus.

A resistance against flow of the gas through the second communication path may be determined to be larger than a resistance against flow of the gas through the vapor path. Therefore, when the air mixed with the fuel vapor flows into the canister via the diaphragm valve as a result of an increase of the pressure within the fuel tank by the generation of fuel vapor, the air mixed with the fuel vapor may be inhibited from flowing into the backpressure chamber via the second communication path. Hence, the pressure within the valve chamber may be kept to be higher than the pressure within the backpressure chamber, so that the valve member may be kept away from the open end of the tubular passage member for keeping the communication between the valve chamber and the vapor path.

A resistance against flow of the gas through the first communication path may be determined to be larger than a resistance against flow of the gas through the vapor path.

In the case that the air mixed with the fuel vapor flown from within the fuel tank toward the canister via the diaphragm valve and the vapor path during a refueling operation has accidentally flown backwards to the backpressure chamber of the diaphragm valve through the first communication path, it may be possible that the pressure within the backpressure chamber increases to close the diaphragm valve. If this occurs, it may be difficult for the air mixed with the fuel vapor to flow into the canister via the diaphragm valve. Therefore, the internal pressure of the fuel tank may be increased to inhibit the refueling operation. However, by determining the resistance against flow of the gas through the first communication path to be larger than the resistance against flow of the gas through the vapor path as described above, it may be possible to inhibit or reduce a backflow of the air mixed with the fuel vapor to the backpressure chamber through the first communication path.

The second communication path may comprise an orifice formed to extend through the diaphragm for communicating between the valve chamber and the backpressure chamber of the diaphragm valve. With this arrangement, it is possible to simplify the construction of the second communication path.

DETAILED DESCRIPTION OF EXEMPLARY EMBODIMENTS

Figure 6:
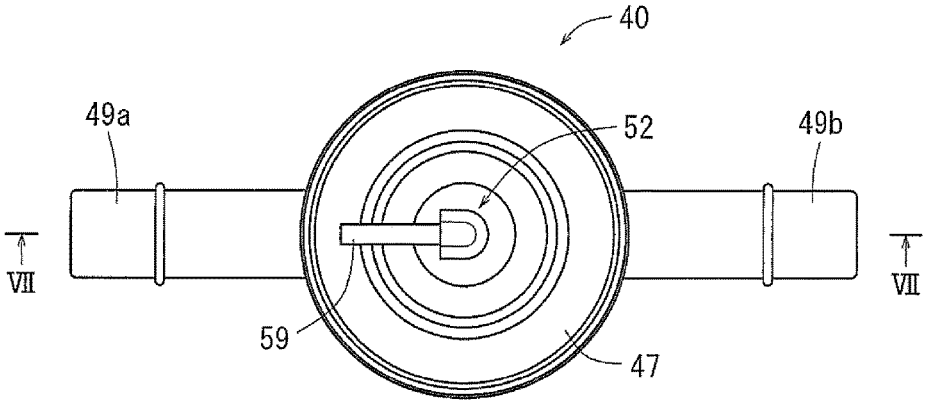
FIG. 6 is a plan view of the diaphragm valve.
Figure 7:
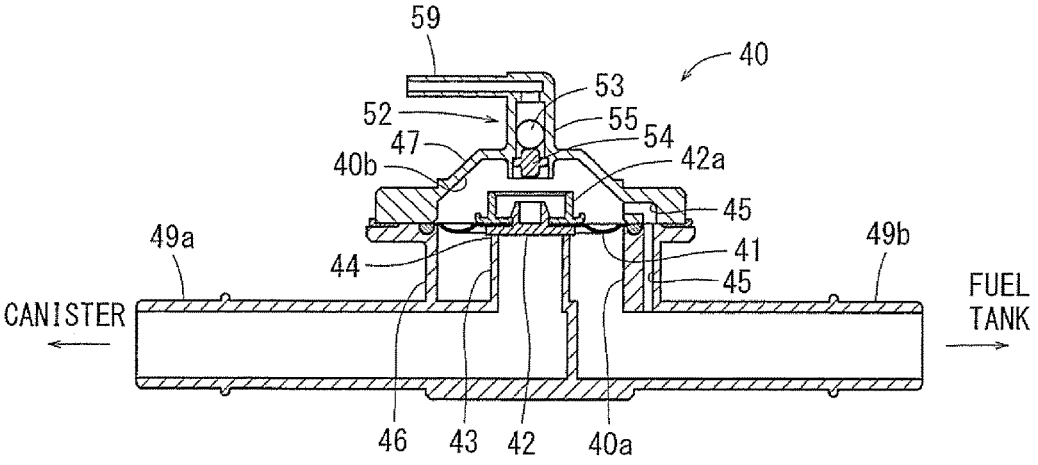
FIG. 7 is a cross sectional view taken along line VII-VII in FIG. 6.
Figure 8:
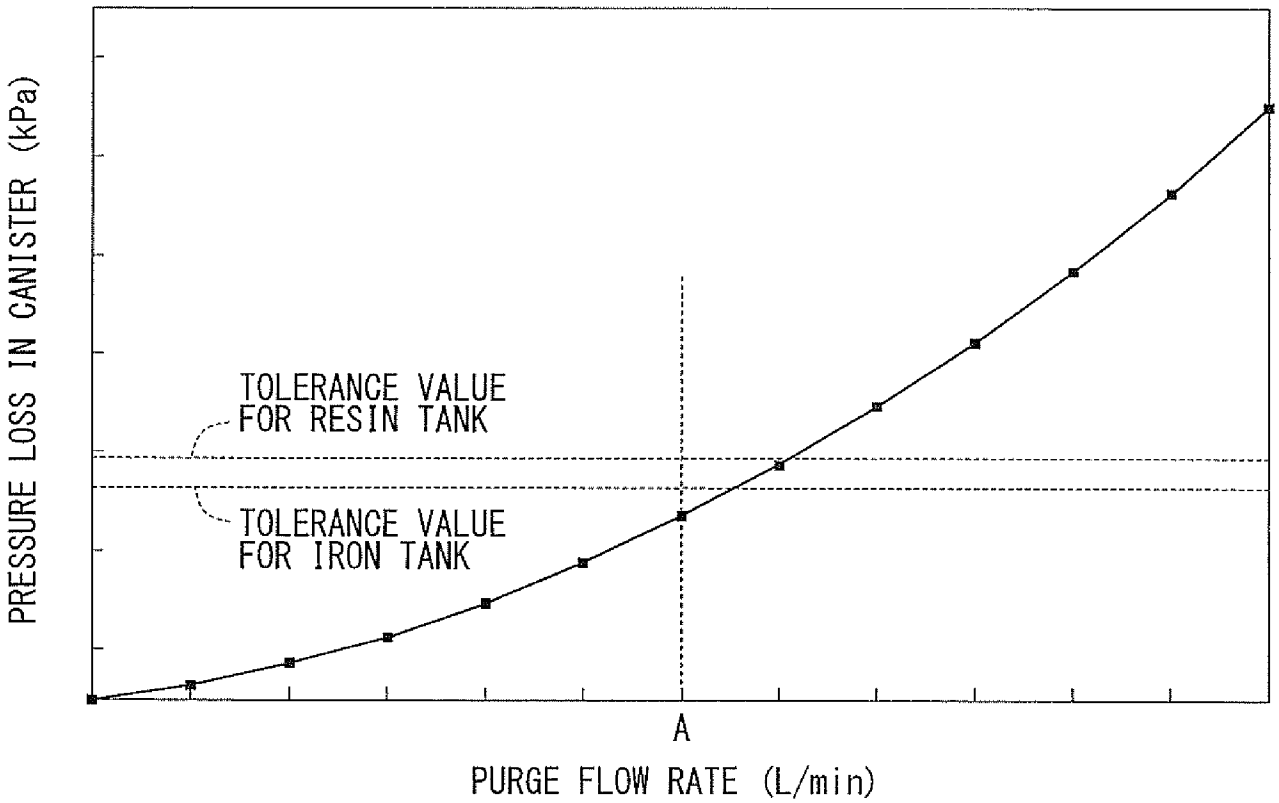
FIG. 8 is a graph illustrating a characteristic of a pressure loss in a canister as compared with a flow rate of a purge gas in the embodiment.

A representative embodiment will now be described with reference to FIGS. 1 to 8. A fuel vapor processing apparatus of this embodiment may include a canister 31 connected to a fuel tank 21 via a vapor path 34. A diaphragm valve 40 may be disposed in the vapor path 34. In this embodiment, an adsorption capacity of the canister 31 for adsorbing fuel vapor and a purge flow rate, i.e. a maximum flow rate of fuel vapor flowing from the canister 31 to an intake passage 12 of an engine 11 may be determined to be larger than those in a conventional fuel vapor processing apparatus in order to meet the demand for an improvement in terms of processing capacity. As illustrated in FIG. 8, the purge flow rate may have a maximum value that is larger than a maximum flow rate "A" of the conventional fuel vapor processing apparatus. With the increase in the adsorption capacity of the canister 31, the pressure loss of the canister 31 may greatly exceed the tolerance values with respect to deformation of the fuel tank 21 both in the case that the fuel tank 21 is made of resin and in the case that the fuel tank is made of iron. In view of this, in this embodiment, the diaphragm valve 40 may shut off the vapor path 34 at the time of purging, so that a negative pressure may not be applied to the fuel tank 21 via the vapor path 34. In the following description, the directions with respect to the diaphragm valve 40 are determined based on the position of the diaphragm valve 40 shown in FIG. 7 as a reference.

Figure 1:
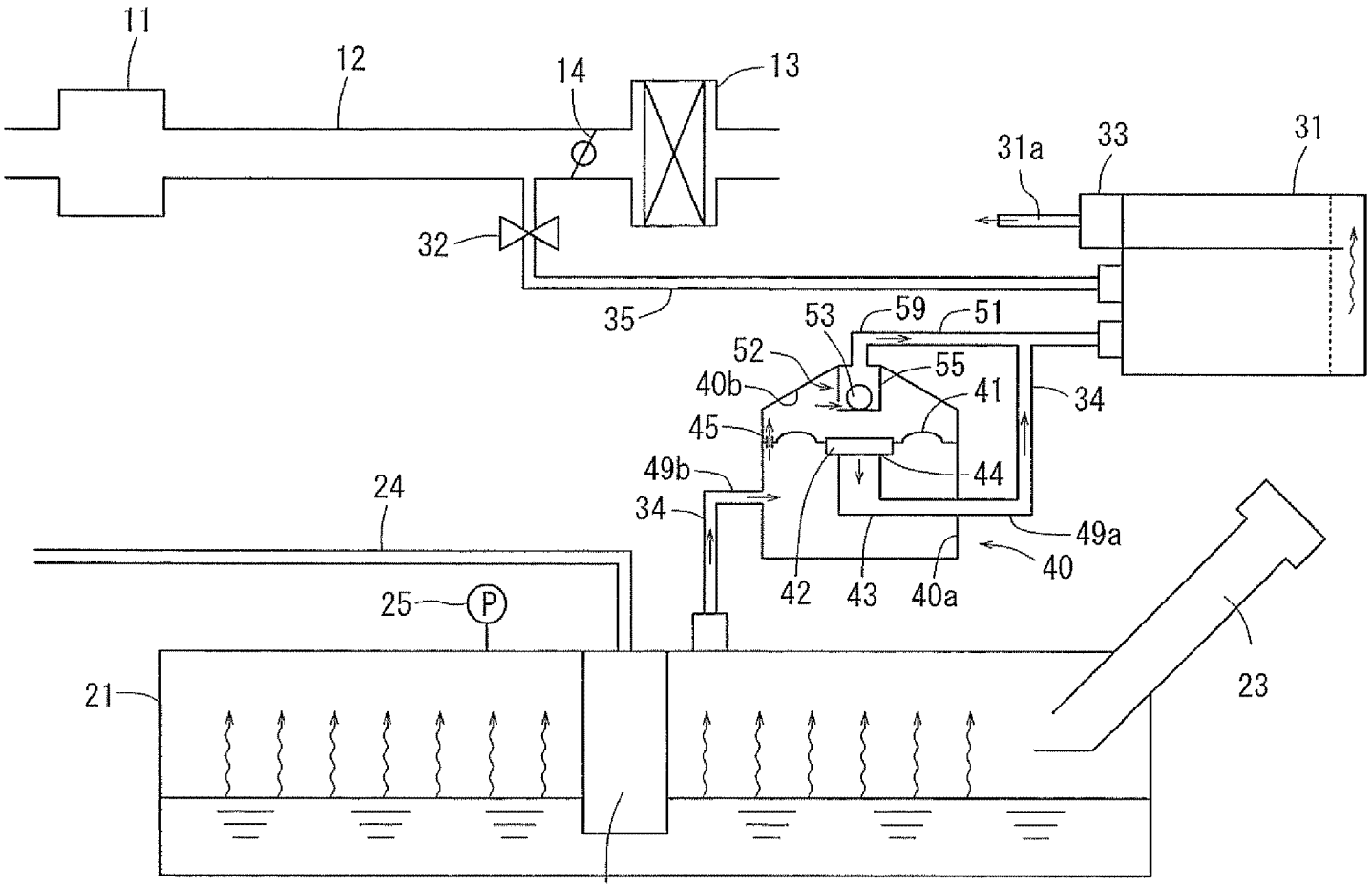
FIG. 1 is a schematic view of an engine system incorporating a fuel vapor processing apparatus according to an embodiment and showing the state in which an engine is at rest or stopped.

As shown in FIG. 1, an air fuel mixture, i.e., a mixture of air and fuel, may be supplied to the intake passage 12 of the engine 11 via a throttle valve 14. The air may be supplied to the intake passage 12 via an air cleaner 13. The throttle valve 14 may control a flow rate of the air. Fuel may be supplied from the fuel tank 21 to the engine 11 via a fuel injection valve(s) (not shown) that may be connected to the fuel tank 21 via a fuel pipe 24. A fuel pump 22 may be disposed within the fuel tank 21 and may pump the fuel stored in the fuel tank 21 into the fuel pipe 24. A refueling pipe 23 may be connected to the fuel tank 21, making it possible to refuel the fuel tank 21.

The vapor path 34 may be connected to the upper portion of the fuel tank 21 and may communicate with a space defined in the upper portion of the fuel tank 21. As described previously, the canister 31 may be connected to the fuel tank 21 via the vapor path 34, so that fuel vapor generated in the fuel tank 21 can be adsorbed by the canister 31 via the vapor path 34. The canister 31 may be further connected to the intake passage 12 via a purge path 35. A purge valve 32 may be disposed in the purge path 35 at a point along the length of the purge path 35. As a result, the fuel vapor adsorbed by the canister 31 can be purged to the intake passage 12 when the purge valve 32 is opened during the operation of the engine 11. At the upper portion of the fuel tank 21, there may be provided a pressure sensor 25 for detecting the pressure of the space within the fuel tank 21.

Figure 5:
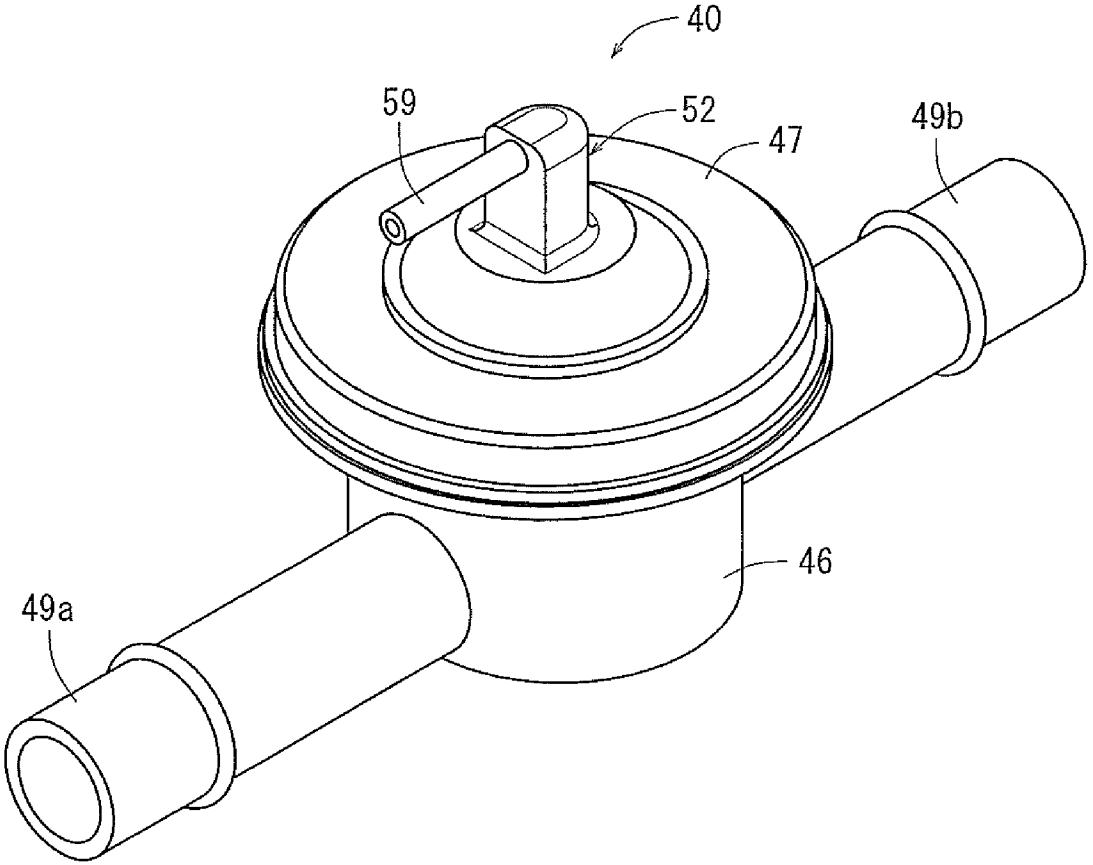
FIG. 5 is an external perspective view of a diaphragm valve of the embodiment.

The diaphragm valve 40 disposed in the vapor path 34 may open and close (shut-off) the vapor path 34. As shown in FIGS. 5 through 7, the diaphragm valve 40 may include a cup-shaped valve main body lower portion 46 and a cup-shaped valve main body upper portion 47 that are joined to each other with a diaphragm 41 held between the valve main body lower portion 46 and the valve main body upper portion 47. Thus, the diaphragm 41 may extend along a joint plane between the valve main body lower portion 46 and the valve main body upper portion 47 and may be clamped therebetween at the entire periphery thereof. In this way, a valve chamber 40*a* may be formed on the lower side of the diaphragm 41, and a backpressure chamber 40*b* may be formed on the upper side of the diaphragm 41. Thus, the diaphragm 41 may serve as a partition provided between the valve chamber 40*a* and the backpressure chamber 40*b*. The diaphragm 41 may be resiliently deformed so as to vary the volumes of the two chambers 40*a* and 40*b* according to the pressure difference between the two chambers 40*a* and 40*b*.

A valve member 42 may be disposed at the central portion of the lower surface of the diaphragm 41. The valve member 42 may be fixedly attached to the diaphragm 41 by joining a fixation member 42*a* to the valve member 42 from the upper side of the diaphragm 41 such that the central portion of the diaphragm 41 is clamped between the fixation member 42*a* and the valve member 42. A tubular passage member 43 may be disposed on the lower side of the valve member 42 and may have an upper open end 44 that is vertically opposed to the lower surface of the valve member 42. The valve member 42 and the tubular passage member 43 may be designed such that, in a free condition (i.e. a condition when no pressure is applied to the diaphragm 41), the valve member 42 contacts the upper open end 44 of the tubular passage member 43 for closing the same. The end portion of the tubular passage member 43 on the side opposite to the upper open end 44 may be joined to a connection pipe 49*a* that may communicate with the canister 31 via the vapor path 34. The tubular passage portion 43 and the connection pipe 49*a* may be formed integrally with the valve body lower portion 46. A connection pipe 49*b* may be also formed integrally with the valve body lower portion 46 and may extend in a direction opposite to the extending direction of the connection pipe 49*a*. The connection pipe 49*b* may communicate with the fuel tank 21 via the vapor path 34.

A second communication path 45 may include a first part and a second part that are formed in a wall of the valve body lower portion 46 and a wall of the valve body upper portion 47, respectively, and may communicate with each other at a joint plane between the valve body lower portion 46 and the valve body upper portion 47. The second communication path 45 may allow communication between the backpressure chamber 40*b* and the fuel tank 21. The second communication path 45 may have a predetermined opening area for allowing flow of a gas (i.e., a mixture of air and fuel vapor) in a predetermined amount from the fuel tank 21 toward the backpressure chamber 40*b*. For example, the second communication path may have an inner diameter of approximately 2 mm. Therefore, a mixture of air and fuel vapor may be permitted to flow from the fuel tank 21 toward a flow control valve 52 that will be described later. In FIGS. 1 through 4, the second communication path 45 is illustrated as an orifice provided in the diaphragm 41 for the purpose of illustration. However, instead of forming the second communication path 45 as shown in FIG. 7, it is also possible to simply form the second communication path 45 as an orifice in the diaphragm 41 as shown in FIGS. 1 through 4.

The flow control valve 52 has a valve body 55 that may be integrally formed with the upper portion of the valve body upper portion 47. A resin ball 53 may be vertically movably inserted into the valve body 55 of the flow control valve 52. A plug-like support member 54 may be mounted within the lower end of the valve body 55 so that the resin ball 53 may not drop from within the valve body 55. While the support member 54 supports the resin ball 53 from the lower side, the support member 54 allows flow of a gas (i.e. a mixture of air and fuel vapor) between the interior of the valve body 55 and the backpressure chamber 40*b* of the diaphragm valve 40. A connection pipe 59 may extend from the upper portion of the valve body 55 and may be connected to the vapor path 34 via a first communication path 51 (see FIG. 1). In the state in which there is no flow of the gas through the valve body 55, the resin ball 53 may be supported on the support member 54 to allow flow of the gas into and out of the valve body 55 via a gap that may be formed between the inner wall of the valve body 55 and the resin ball 53. On the other hand, if the flow rate per unit time of the gas flowing from the backpressure chamber 40*b* toward the connection pipe 59 becomes equal to or more than a predetermined value, the resin ball 53 may be pushed up by the flow of the gas to close the inlet of the connection pipe 59.

The inner diameter of each of the connection pipe 59 and the first communication path 51 may be determined to be smaller than the inner diameter of the connection pipe 49*a* and also smaller than the inner diameter of the vapor path 34. For example, the inner diameter of each of the connection pipe 59 and the first communication path 51 may be set to be approximately 2 to 4 mm, and the inner diameter of each of the connection pipe 49*a* and the vapor path 34 may be set to be approximately 14 mm. Therefore, as compared with the resistance against flow of the gas of each of the connection pipe 49*a* and the vapor path 34, which define a flow path from the diaphragm valve 40 toward the canister 31, the resistance against flow of the gas of each of the connection pipe 59 and the first communication path 51 may be larger. As a result, the gas (i.e., air mixed with fuel vapor) flowing toward the canister 31 from the diaphragm 40 via the connection pipe 49*a* and the vapor path 34 may be suppressed from flowing backwards to the connection pipe 59 and the first connection path 51.

The above construction may suppress the occurrence of the problem in which it becomes difficult to perform the refueling operation due to an increase of the internal pressure of the fuel tank 21 as a result of closing the diaphragm valve 40 during the refueling operation. That is, if, during the refueling operation, the air mixed with fuel vapor flowing toward the canister 31 from the fuel tank 21 via the diaphragm valve 40 and the vapor path 34 is caused to flow backwards to the backpressure chamber 40*b* through the first communication path 51 and the connection pipe 59, there is a possibility that the pressure within the pressure chamber 40*b* increases to close the diaphragm valve 40. Then, the flow of the air mixed with fuel vapor to reach the canister 31 via the diaphragm valve 40 may be suppressed to cause an increase of the internal pressure of the fuel tank 21, whereby the refueling operation may be inhibited. However, according to this embodiment, it may be possible to inhibit the air mixed with vaporized fuel from flowing backwards to the backpressure chamber 40*b* via the first communication path 51 and the connection pipe 59, so that it may be possible to suppress the occurrence of such a problem.

Next, the operation of the fuel vapor processing apparatus according to this embodiment will be described. In the state shown in FIG. 1, the engine 11 is at rest or stopped, and a relatively large amount of fuel vapor may be generated in the fuel tank 21 as indicated by arrows. The fuel vapor may flow to the canister 31 via the vapor path 34 and may be adsorbed by an adsorbent, such as activated carbon (not shown), stored in the canister 31. In this state, the pressure in the backpressure chamber 40*b* of the diaphragm valve 40 may be equal to the atmospheric pressure due to communication with the atmosphere via an atmospheric port 31*a* of the canister 31. Therefore, as the pressure of the fuel vapor increases, the diaphragm 41 and the valve member 42 attached thereto of the diaphragm valve 40 may be pushed up so as to be slightly spaced away from the upper open end 44 of the tubular passage member 43, so that the air mixed with fuel vapor can flow into the tubular passage member 43. The air mixed with fuel vapor may also flow into the backpressure chamber 40*b* via the second communication path 45, and the air mixed with fuel vapor having flown into the backpressure chamber 40*b* may flow into the canister 31 via the flow control valve 52. At this time, the flow rate per unit time of the air mixed with fuel vapor flowing through the flow control valve 52 may be less than the predetermined value, so that the flow control valve 52 may not be closed. In this way, the canister 31 may adsorb the fuel vapor generated in the fuel tank 21 while the engine 11 is at rest or stopped.

Figure 2:
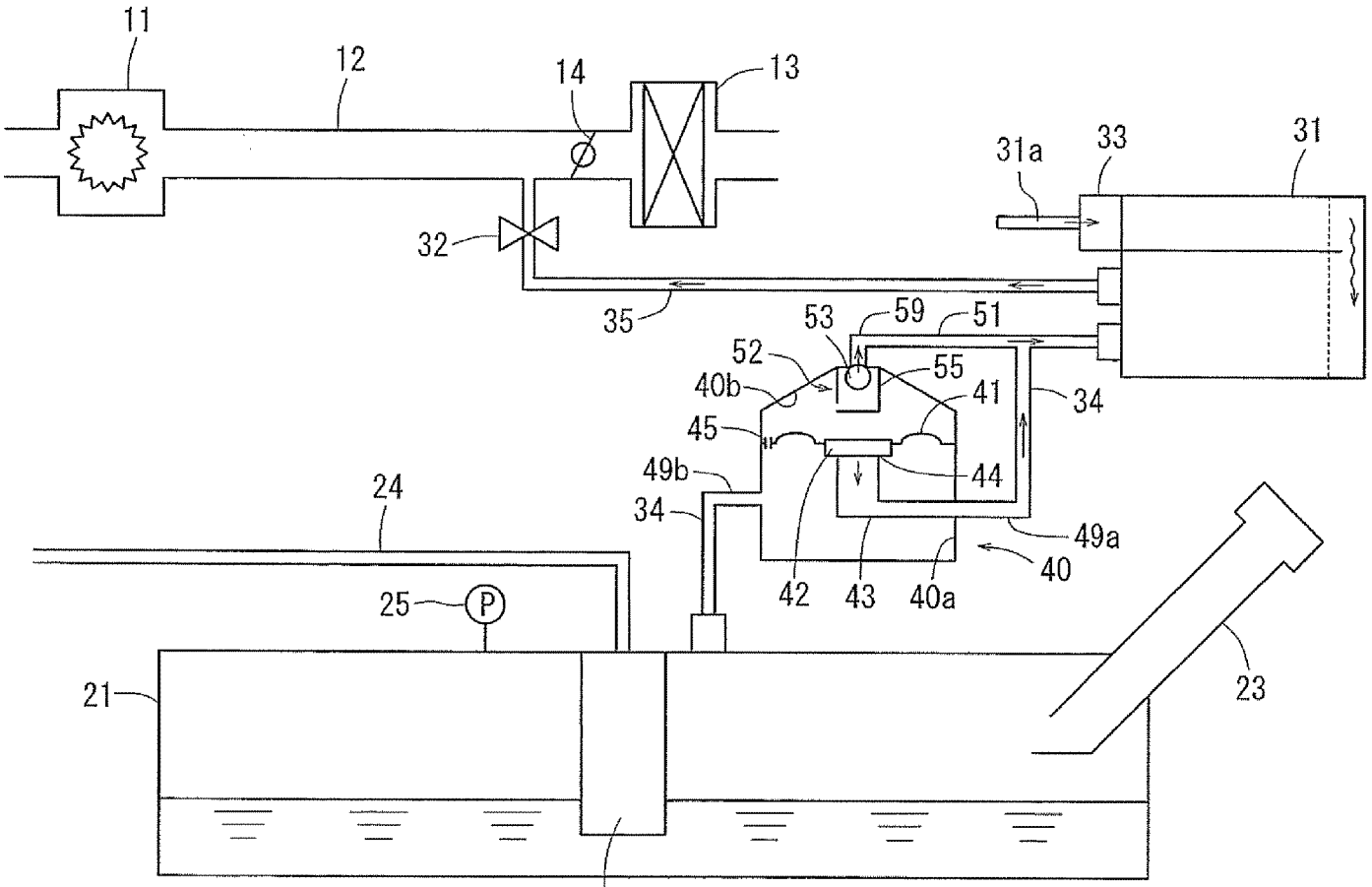
FIG. 2 is a schematic view similar to FIG. 1 but showing the state during the operation of the engine.

FIG. 2 shows the state in which the engine 11 is being operated. During the operation of the engine 11, the purge valve 32 may be opened for performing the purge operation of the canister 31. As described previously with reference to FIG. 8, the negative pressure in the vapor path 34 may increase due to the increase in the adsorption capacity of the canister 31 and due to the increase in the pressure loss of the canister 31 as a result of the increase in the purge flow rate. Before the purge valve 32 is opened, the pressure in the backpressure chamber 40*b* of the diaphragm valve 40 may be equal to the atmospheric pressure due to communication with the atmospheric port 31*a* of the canister 31. Therefore, the valve body 42 may move to close the upper open end 44 of the tubular passage member 43 at the same time a negative pressure is applied to the canister 31 due to opening of the purge valve 32. Thus, the negative pressure applied to the canister 31 may be prevented from being applied to the fuel tank 21 via the diaphragm valve 40. At the same time, the flow rate per unit time of the air mixed with fuel vapor flowing through the flow control valve 52 via the first communication path 51 may become not less than (i.e., greater than or equal to) the predetermined value, so that the resin ball 53 may close the inlet port of the connection pipe 59. In this way, the flow control valve 52 may be closed. Therefore, the pressure in the backpressure chamber 40*b* of the diaphragm valve 40 can be maintained at a level higher than the pressure within the tubular passage member 43. Therefore, even in the case that the pressure loss of the canister 31 has increased to cause an increase of the negative pressure applied to the vapor path 34 as illustrated in FIG. 8, the negative pressure may not be applied to the fuel tank 21, so that it may be possible to prevent unfavorable deformation of the fuel tank 21. Further, it may be possible to prevent the fuel vapor generated in the fuel tank 21 from being directly drawn into the engine 11, whereby it is possible to suppress disturbance in the air fuel ratio of the engine 11.

Figure 3:
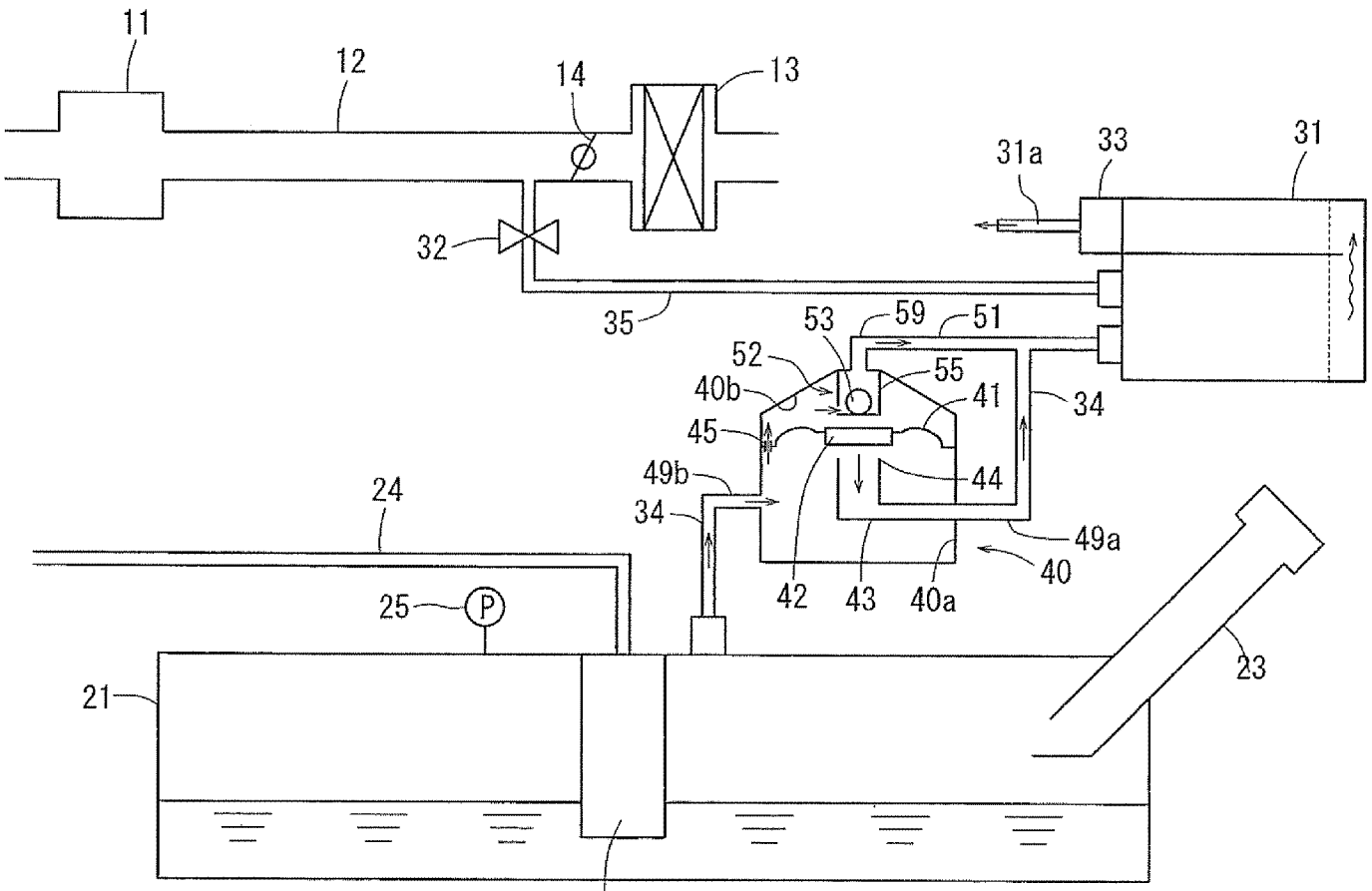
FIG. 3 is a schematic view similar to FIG. 1 but showing the state during a refueling operation.

FIG. 3 illustrates the state in which the fuel is supplied to the fuel tank 21 for refueling. During the refueling operation, as the fuel level in the fuel tank 21 increases, the air mixed with fuel vapor that existed in the space in the fuel tank 21 may be discharged toward the canister 31 via the vapor path 34. Similar to the case of FIG. 1, the valve member 42 may be pushed up so as to be spaced away from the upper open end 44 of the tubular passage member 43 as the pressure of the valve chamber 40*a* increases. Therefore, the diaphragm 41 of the diaphragm valve 40 may permit flow of the gas (i.e., a mixture of air and fuel vapor) from the valve chamber 40*a* toward the vapor path 34. Further, the amount of the gas flowing through the flow control valve 52 per unit time may be less than the predetermined value, and therefore, the flow control valve 52 may also allow flow of the gas. Thus, an increase in the pressure of the fuel tank 21 during the refueling operation may be suppressed, making it possible to perform the refueling operation without a hindrance. That is, if the diaphragm valve 40 is closed, the pressure within the fuel tank 21 may increase. In one example, the fuel tank 21 may be provided with an automatic stopping device (not shown) that may automatically stop or prevent the refueling operation in response to an increase in the pressure within the fuel tank 21. Therefore, if the automatic stopping device has operated, it is not possible to perform the refueling operation in a usual manner.

Figure 4:
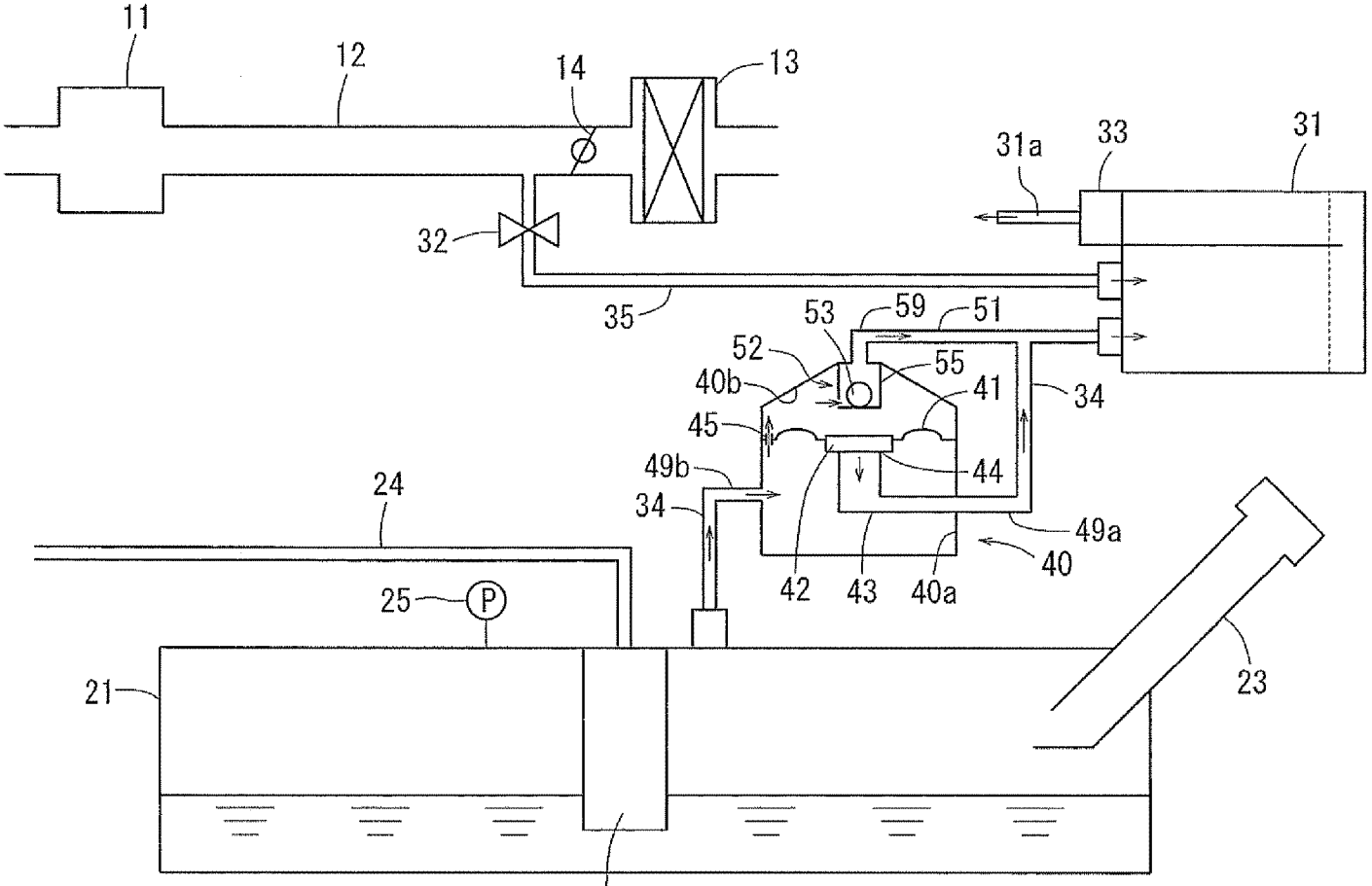
FIG. 4 is a schematic view similar to FIG. 1 but showing the state during an OBD (on-board diagnosis), in particular a leakage diagnosis.

FIG. 4 illustrates a state in which the fuel vapor processing apparatus inclusive of the fuel tank 21 and the canister 31 is undergoing an on-board diagnosis (OBD), in particular, an air leakage diagnosis. To perform this diagnosis, an OBD pump 33 may be operated to generate a weak (i.e., relatively small) negative pressure while the purge valve 32 is closed. Therefore, the negative pressure may be applied to the fuel tank 21 via the canister 31, the first communication path 51, the second communication path 45, and the flow control valve 52. If there is no leakage of air from the fuel vapor processing apparatus inclusive of the fuel tank 21, the canister 31, and the path establishing communication between them, the pressure of the space in the fuel tank 21 may gradually decrease with passage of time, so that it is possible to make a leakage diagnosis based on the pressure detected by the pressure sensor 25 after a predetermined period of time. While in this embodiment the air leakage diagnosis is made by using the pressure sensor 25, it is also possible to make the air leakage diagnosis without providing any pressure sensor in the case where the OBD pump 33 is endowed with a pressure detecting function.

The flow of air that may be caused by the negative pressure of the OBD pump 33 may be relatively small, and the amount of air flowing per unit time may be less than the predetermined value, so that the resin ball 53 does not close the inlet port of the connection pipe 59 within the flow control valve 52. Therefore, although the diaphragm valve 40 is provided in the vapor path 34, it is possible to execute the OBD in a usual manner. Further, although the negative pressure may be applied to the tubular passage member 43 of the diaphragm valve 40 via the vapor path 34, the negative pressure may be relatively small as described above. In addition, because the negative pressure is also applied to the backpressure chamber 40*b* on the opposite side of the diaphragm 41, the valve member 42 of the diaphragm valve 40 scarcely operates, and does not affect the execution of the OBD.

As described above, according to the above embodiment, prior to performing the purge operation, the atmospheric pressure may be applied to the backpressure chamber 40*b* of the diaphragm valve 40 via the atmospheric port 31*a* of the canister 31. Thus, when, at the start of the purging, a negative pressure is applied to the tubular passage member 43 via the vapor path 34, the valve member 42 may move to close the upper open end 44 of the tubular passage member 43 to close or shut off the vapor path 34. Thus, even in the case that the backpressure chamber 40*b* is not open to the atmosphere, it is possible to cause deformation of the diaphragm 41 for shutting off the vapor path 34 by the diaphragm valve 40. Accordingly, even in the case that the diaphragm 41 has been accidentally damaged, it may be possible to prevent the fuel vapor (flown from within the fuel tank 21) from being dissipated into the atmosphere although the fuel vapor may flow into the canister 31 via the backpressure chamber 40*b*. Furthermore, because the diaphragm valve 40 can automatically mechanically operate without need of an electrical control, it is possible to manufacture the diaphragm valve 40 at a low cost.

The above embodiment may be modified in various ways. For example, while in the above embodiment the flow control valve 52 is provided integrally at a region between the valve body upper portion 47 of the diaphragm valve 40 and the connection pipe 59, the flow control valve 52 may be provided in the first communication path 51 or in the second communication path 45. In the case where, as in the above embodiment, the second communication path 45 includes the first part formed in the valve body lower portion 46 and the second part formed in the valve body upper portion 47 of the diaphragm valve 40, the flow control valve 52 may be provided integrally with the diaphragm valve 40 at the first part or the second part.

The various examples described above in detail with reference to the attached drawings are intended to be representative of the invention and thus not limiting. The detailed description is intended to teach a person of skill in the art to make, use and/or practice various aspects of the present teachings and thus is not intended to limit the scope of the invention. Furthermore, each of the additional features and teachings disclosed above may be applied and/or used separately or with other features and teachings to provide improved fuel vapor processing apparatuses, and/or methods of making and using the same.

Moreover, the various combinations of features and steps disclosed in the above detailed description may not be necessary to practice the invention in the broadest sense, and are instead taught to describe representative examples. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel vapor processing apparatus comprising:

a canister in fluid communication with a fuel tank via a vapor path and configured to adsorb fuel vapor generated in the fuel tank;

wherein the canister is further in fluid communication with an engine via a purge path and is further configured to allow the adsorbed fuel vapor to be desorbed and purged to an engine by an intake negative pressure generated by the engine when the engine is operating, a diaphragm valve configured to open and close the vapor path, the diaphragm valve comprising:

a valve chamber in fluid communication with the vapor path;

a backpressure chamber arranged so as to be opposed to the valve chamber;

a diaphragm partitioning the valve chamber and the backpressure chamber from each other, so that a volume of the valve chamber and a volume of the backpressure chamber vary according to a pressure difference between the valve chamber and the backpressure chamber;

a valve member arranged on a side of the valve chamber and integrated with the diaphragm; and a tubular passage member defining a part of the vapor path and in fluid communication with the canister, the tubular passage member having an open end disposed within the valve chamber and opposed to the valve member, wherein when a negative pressure is applied to the open end of the tubular passage member via the canister, the valve member moves to contact and close the open end, so that the vapor path is shut off;

wherein the backpressure chamber is in communication with the canister via a first communication path and is further in communication with the fuel tank via a second communication path; and a flow control valve configured to control a flow of a gas flowing from the fuel tank to the canister via the backpressure chamber and the first and second communication paths;

wherein the flow control valve is closed to keep a pressure within the backpressure chamber higher than a pressure within the tubular passage member when a flow rate of gas per unit time flowing from within the backpressure chamber to the first communication path via the flow control valve is equal to or more than a predetermined value, and the flow control valve is opened when the flow rate of the gas per unit time is less than the predetermined value.

2. The fuel vapor processing apparatus according to claim 1, wherein the flow control valve is integrated with the diaphragm valve.

3. The fuel vapor processing apparatus according to claim 2, wherein the flow control valve is disposed at a region of the diaphragm valve where the backpressure chamber and the first communication path are connected to each other.

4. The fuel vapor processing apparatus according to claim 1, wherein a resistance against flow of the gas through the second communication path is larger than a resistance against flow of the gas through the vapor path.

5. The fuel vapor processing apparatus according to claim 1, wherein a resistance against flow of the gas through the first communication path is larger than a resistance against flow of the gas through the vapor path.

6. The fuel vapor processing apparatus according to claim 1, wherein the second communication path comprises an orifice formed to extend through the diaphragm for communicating between the valve chamber and the backpressure chamber of the diaphragm valve.

7. The fuel vapor processing apparatus according to claim 1, wherein:

the flow control valve comprises a mechanical valve configured to open and close according only to a change in the flow rate of gas.

8. The fuel vapor processing apparatus according to claim 7, wherein:

the flow control valve is disposed within the backpressure chamber.

9. The fuel vapor processing apparatus according to claim 8, wherein the flow control valve comprises:

a valve body including an upper open end and a lower open end and extending substantially vertically within the backpressure chamber;

a ball disposed within the valve body and vertically movable between an upper closing position and a lower open position;

wherein the upper open end is in fluid communication with the first communication path, and the lower open end directly communicates within the backpressure chamber;

wherein the ball is positioned at the lower open position when the flow rate of gas per unit time is less than the predetermined value; and wherein the ball is forced to move from the lower open position to the upper closing position as the flow rate of gas per unit time increases to be equal to or more than the predetermined value.

10. The fuel vapor processing apparatus according to claim 9, wherein:

the lower open end of the valve body of the flow control valve is located directly above the open end of the tubular passage member.

11. The fuel vapor processing apparatus according to claim 1, further comprising a purge valve disposed in the purge path and configured to open and close the purge path;

wherein the purge valve is configured to open during the operation of the engine, so that:

the negative pressure of the canister is applied to the open end of the tubular passage member to close the open end, and at the same time or subsequently, the flow rate of gas per unit time flowing from within the backpressure chamber to the first communication path via the flow control valve becomes equal to or more than the predetermined value to close the flow control valve.

* * * * *